US010151453B2

(12) United States Patent
Duckworth et al.

(10) Patent No.: US 10,151,453 B2
(45) Date of Patent: Dec. 11, 2018

(54) DIRECTIONAL ACCENT LUMINAIRE

(71) Applicant: Hubbell Incorporated, Shelton, CT (US)

(72) Inventors: Jason Duckworth, Simpsonville, SC (US); Steve Entrekin, Simpsonville, SC (US)

(73) Assignee: Hubbell Incorporated, Shelton, CT (US)

( * ) Notice: Subject to any disclaimer, the term of this patent is extended or adjusted under 35 U.S.C. 154(b) by 219 days.

(21) Appl. No.: 14/984,781

(22) Filed: Dec. 30, 2015

(65) Prior Publication Data

US 2016/0320026 A1 Nov. 3, 2016

Related U.S. Application Data

(60) Provisional application No. 62/155,979, filed on May 1, 2015.

(51) Int. Cl.

| | |
|---|---|
| ***F21V 15/01*** | (2006.01) |
| ***F21V 7/00*** | (2006.01) |
| ***F21V 31/00*** | (2006.01) |
| ***F21V 29/76*** | (2015.01) |
| *F21V 29/503* | (2015.01) |
| *F21V 21/30* | (2006.01) |
| *F21V 23/00* | (2015.01) |
| *F21Y 115/10* | (2016.01) |

(52) U.S. Cl.

CPC ..... *F21V 15/01* (2013.01); *F21V 7/0025* (2013.01); *F21V 29/763* (2015.01); *F21V 31/005* (2013.01); *F21V 21/30* (2013.01); *F21V 23/009* (2013.01); *F21V 29/503* (2015.01); *F21Y 2115/10* (2016.08)

(58) Field of Classification Search

CPC ..... F21V 29/763; F21V 29/2212

See application file for complete search history.

(56) References Cited

U.S. PATENT DOCUMENTS

| | | | | |
|---|---|---|---|---|
| 4,617,615 | A | 10/1986 | Eychaner | |
| 5,535,109 | A | 7/1996 | Moore et al. | |
| D435,925 | S | 1/2001 | Hiller | |
| D698,476 | S | 1/2014 | Korpi | |
| D698,477 | S | 1/2014 | Korpi | |
| D747,525 | S | 1/2016 | Guercio | |
| D748,838 | S | 2/2016 | Brynjolfsson | |
| 2006/0215408 | A1* | 9/2006 | Lee | F21V 9/08 362/294 |
| 2009/0262542 | A1 | 10/2009 | Li et al. | |
| 2012/0008331 | A1 | 1/2012 | Marquardt et al. | |
| 2012/0057352 | A1 | 3/2012 | Wilcox et al. | |
| 2013/0293385 | A1 | 11/2013 | Yoshida et al. | |
| 2015/0198310 | A1* | 7/2015 | Scarlata | F21V 29/507 362/249.01 |

OTHER PUBLICATIONS

PCT/US2015/068125 International Search Report and Written Opinion dated Feb. 25, 2016.

* cited by examiner

*Primary Examiner* — Anne M Hines
(74) *Attorney, Agent, or Firm* — Michael Best & Friedrich, LLP

(57) ABSTRACT

A luminaire includes a front housing having an interior portion and a back wall. A rear housing having a front opening is connected to the front housing. A gasket is positioned between the front housing and the rear housing to seal the front opening.

17 Claims, 6 Drawing Sheets

DIRECTIONAL ACCENT LUMINAIRE

RELATED APPLICATION(S)

This application is based on U.S. Provisional Application Ser. No. 62/155,979, filed May 1, 2015, the disclosure of which is incorporated herein by reference in its entirety and to which priority is claimed.

FIELD

Various exemplary embodiments relate to light fixtures or luminaires, for example accent light fixtures designed to illuminate streets, paths, houses, landscapes, parking lots, or other indoor or outdoor areas.

BACKGROUND

Light fixtures, or luminaires, are used with electric light sources to provide an aesthetic and functional housing in both interior and exterior applications. One type of light fixture is an accent light, generally used for interior and exterior lighting of specific areas. Examples of interior areas can include accent lighting for stairs, displays, and artwork. Examples of exterior lighting can include lawns, homes, landscaping features, and pathways. In recent years, lighting applications, including area lights have trended towards the use of light emitting diodes (LEDs) as a light source in place of conventional incandescent and fluorescent lamps.

SUMMARY

According to an exemplary embodiment, a luminaire includes a front housing having an interior portion and a back wall. A rear housing having a front opening is connected to the front housing. A gasket is positioned between the front housing and the rear housing to seal the front opening.

According to another exemplary embodiment, a luminaire includes a front housing having an interior portion and a back wall. A rear housing having a front opening is connected to the front housing. A control component is positioned in the rear housing. A light emitter is positioned in the front housing and operably connected to the control component.

According to another exemplary embodiment, a luminaire includes a front housing and a rear housing. The front housing has an interior portion. An outer reflector is positioned in the interior portion of the front housing. An inner reflector is connected to the outer reflector. The rear housing is connected to the front housing.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
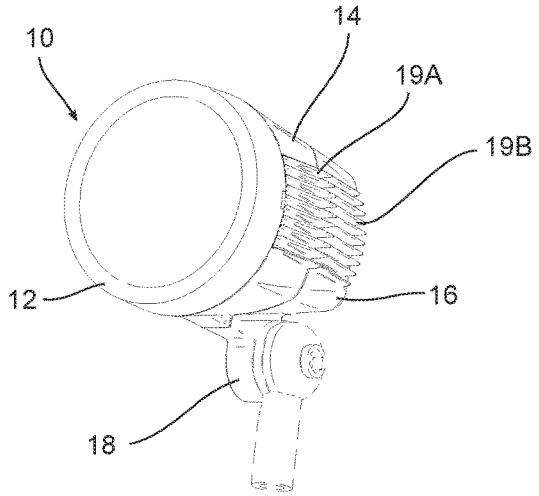
FIG. 1 is a front perspective view of an exemplary luminaire.

Various exemplary embodiments disclosed herein are for use with luminaires, for example outdoor luminaires having a moveable bullet-type housing 10. The housing 10 includes a shroud 12, a front housing 14, and a rear housing 16. A mounting component 18 extends from the housing 10, for example the rear housing 16. The housing components can be mechanically connected to one another, for example through fasteners, threads, and/or snap-fit connections.

In an exemplary embodiment, the front housing 14 includes a first set of fins 19A and the rear housing 16 includes a second set of fins. The fins 19A, 19B can align with one another to create a smooth transition. The fins 19A, 19B can help dissipate heat, effectively turning the housing 10 into a heat sink.

Figure 4:
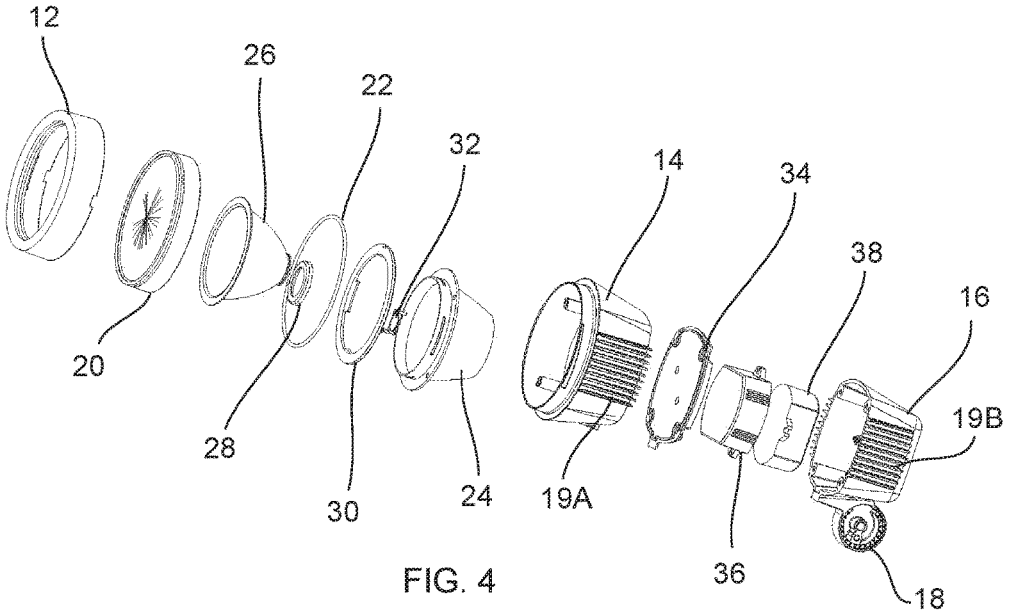
FIG. 4 is an exploded view of the luminaire of FIG. 1.
Figure 5:
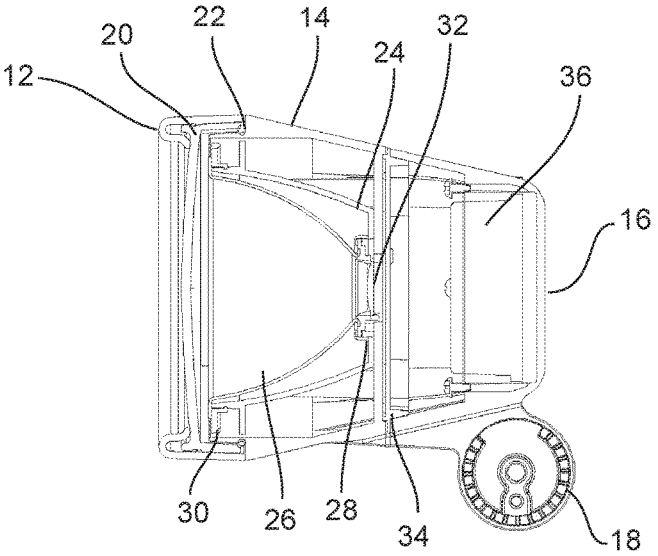
FIG. 5 is a right side, sectional view of the luminaire of FIG. 1.

FIGS. 4 and 5 show an exemplary embodiment of the interior components of the luminaire. A lens 20 is connected to the front housing 14, for example through a threaded connection. The shroud 12 is positioned over and around the lens 20. An O-ring 22 is positioned between the lens 20 and the front housing 14 to form a seal. An outer reflector 24 and an inner reflector 26 having a base 28 can be positioned in the front housing 14. A trim member 30 can be positioned between the outer and inner reflectors 24, 26. The reflectors 24, 26 surround a light emitter, for example an LED 32. A gasket 34 is positioned between the front housing 14 and the rear housing 16. A control component is positioned in the rear housing 16. For example, a driver bracket 36 and a driver module 38 are positioned in the rear housing 16 and can be connected, for example with one or more fasteners.

Figure 6:
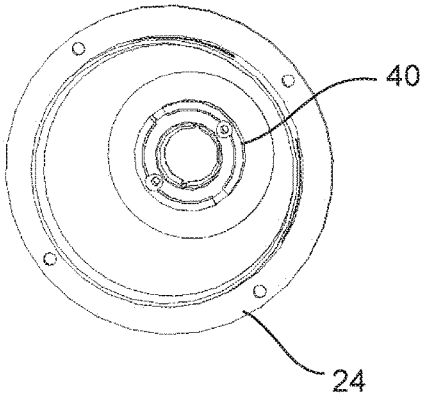
FIG. 6 is a perspective view of an exemplary outer reflector.
Figure 7:
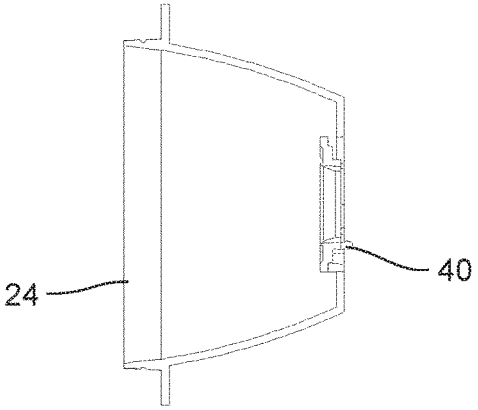
FIG. 7 is a right side, sectional view of the reflector of FIG. 6.
Figure 8:
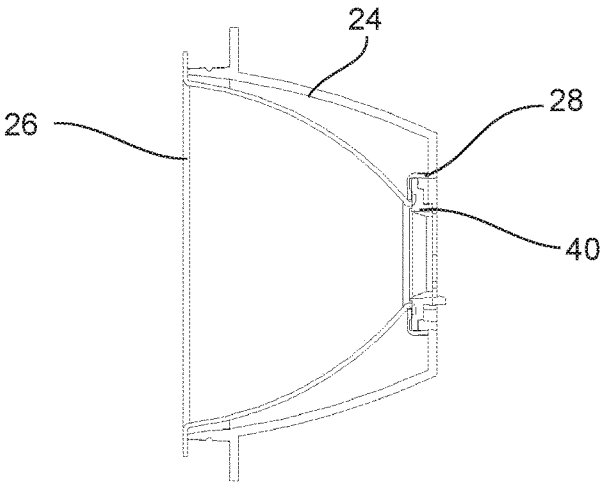
FIG. 8 is a right side, sectional view of an outer and inner reflector.

In an exemplary embodiment, the outer reflector 24 is provided in the front housing 14 to provide a first light distribution. The first light distribution can be modified by the optional addition of different inner reflectors 26. As best shown in FIGS. 6-8, the outer reflector 24 includes a mounting feature 40. In the illustrated exemplary embodiment, the mounting feature 40 includes a protrusion having a flange. Different types of inner reflectors 26 can be positioned in the outer reflector 24 and the base 28 of the inner reflector 26 can be crimped over the mounting feature 40. Other connections such as rotatable connections, including threaded and bayonet, press-fit, snap-fit, or fasteners can also be used.

Figure 9:
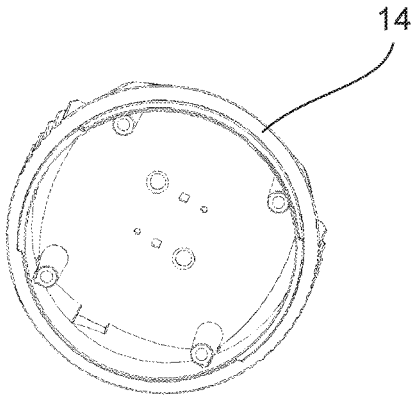
FIG. 9 is a front perspective view of an exemplary front housing.
Figure 10:
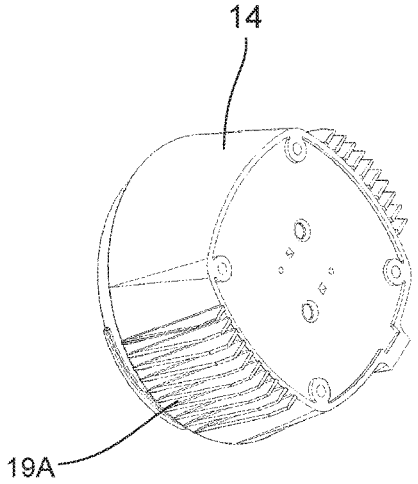
FIG. 10 is a rear perspective view of the front housing of FIG. 9.

FIGS. 9 and 10 show the front housing 14 which has an interior compartment and a back wall that separates the interior compartment from the rear housing 16. The front housing 14 also includes various openings and features to connect the front housing 14 to the rear housing 16 and to connect other components to, and in, the front housing 14. In an exemplary embodiment the LED module 32 is connected to the back wall of the front housing 14, for example a direct connection. Openings in the back wall can also allow for one or more conductors to pass through the back wall to the LED module 32. As best shown in FIG. 10, the back of the front housing 14 can include a raised edge.

Figure 11:
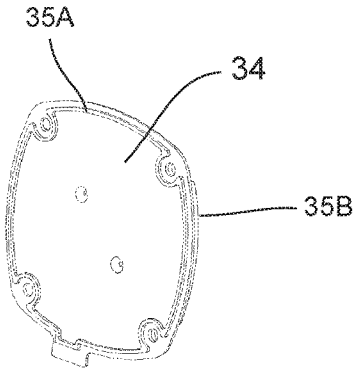
FIG. 11 is a front perspective view of an exemplary gasket.
Figure 12:
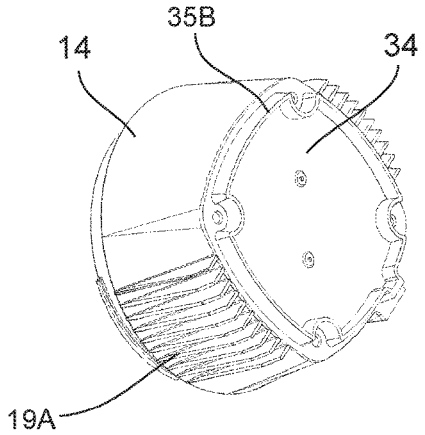
FIG. 12 is a rear perspective view of the gasket attached to the front housing.
Figure 13:
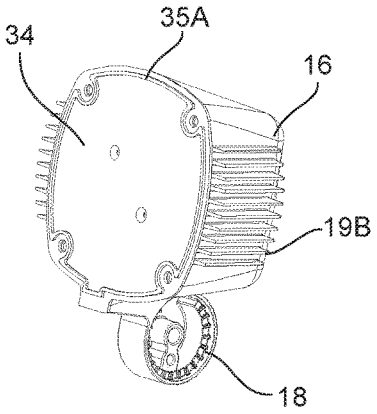
FIG. 13 is a front perspective view of the gasket attached to the rear housing.

FIG. 11 shows the gasket 34, FIG. 12 shows the gasket 34 connected to the front housing 14, and FIG. 13 shows the gasket 34 connected to the rear housing 16. The gasket 34 includes a base having a first flange 35A extending from a first side and a second flange 35B extending from a second side. The first flange 35A fits into the front housing 14 and the second flange 35B fits into the rear housing. The first and second flanges 35A, 35B can include curved regions, for example in the corners, to accommodate mounting or connecting features in the housings 14, 16. The outer edge of the gasket 34 can be approximately aligned with the outer surfaces of the front and rear housings 14, 16 so that an overall smooth appearance is provided. The gasket 34 also acts to the seal the rear housing 16 and to at least partially isolate the driver 38. One or more openings are provided in the gasket 34 for conductors to pass from the driver to the LED module 32.

Figure 14:
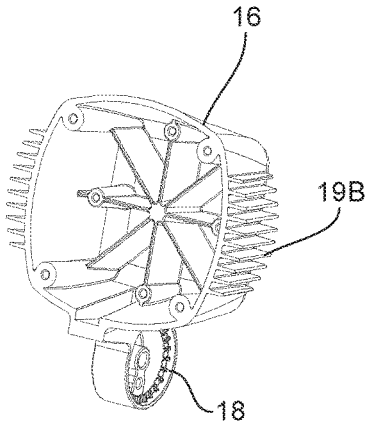
FIG. 14 is a front perspective view of an exemplary rear housing.
Figure 15:
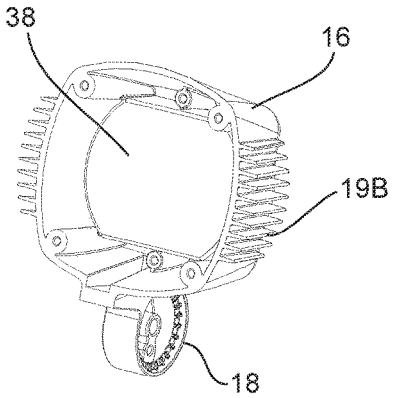
FIG. 15 is a front perspective view of another exemplary rear housing and a driver module.

FIG. 14 shows an exemplary embodiment of a rear housing 16 that includes one or more interior fins connected to a back wall. The driver module 38 can be positioned on the interior fins and retained by the driver bracket 36 that is connected with one or more fasteners. FIG. 15 shows an embodiment where the interior fins are removed and the driver is positioned near or directly on the back wall. Mounting features, including the illustrated bosses can be shortened or otherwise modified to accommodate the various placements.

Figure 2:
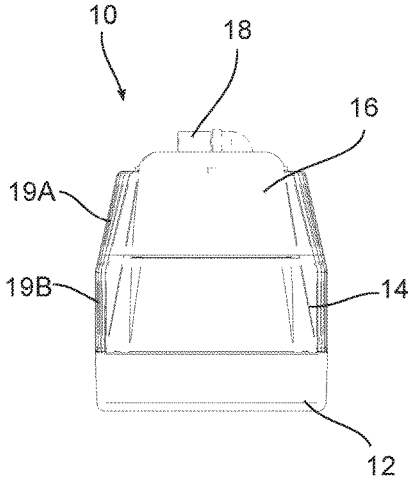
FIG. 2 is a top view of the luminaire of FIG. 1.
Figure 3:
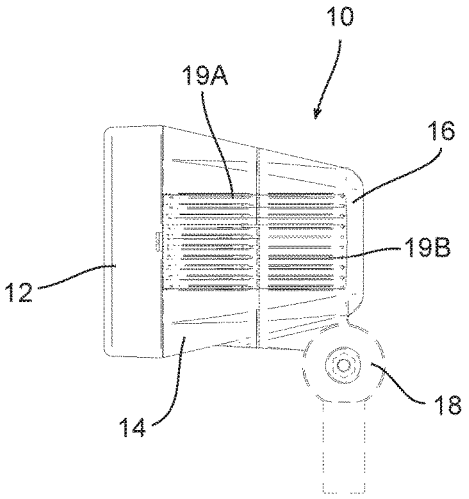
FIG. 3 is a right side view of the luminaire of FIG. 1.
Figure 16:
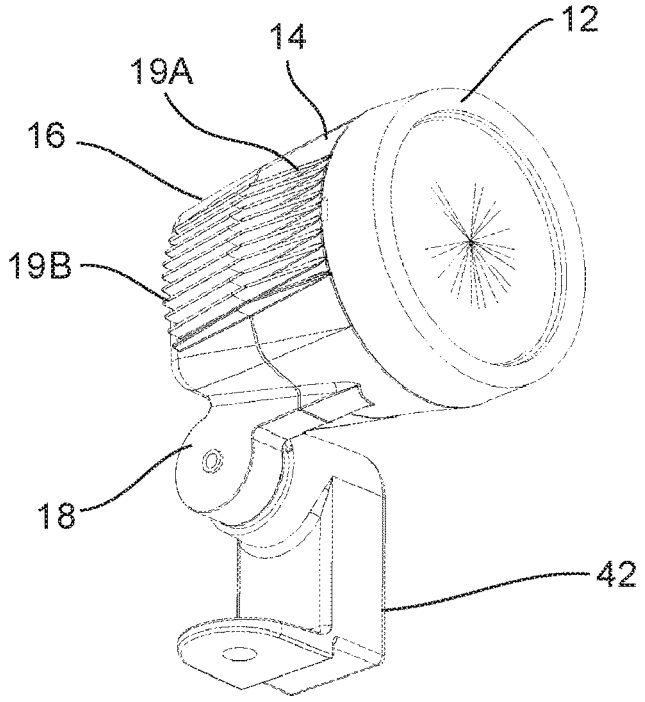
FIG. 16 is a front perspective view of the luminaire of FIG. 1 with an optional mounting device.
Figure 17:
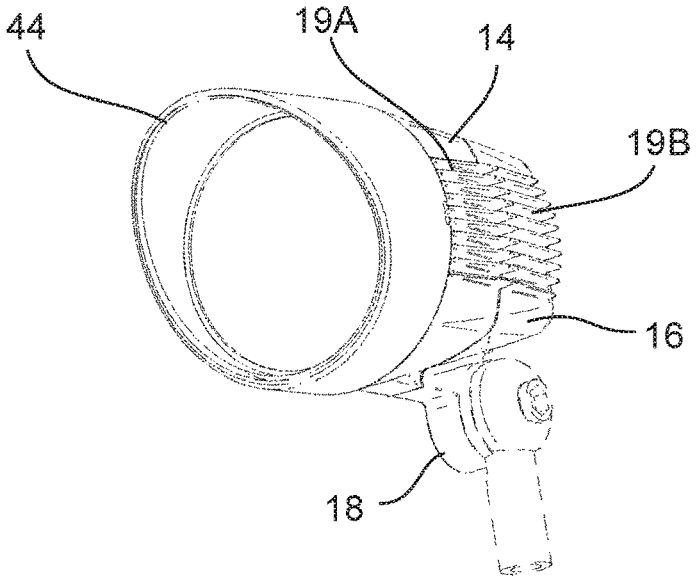
FIG. 17 is a front perspective view of the luminaire of FIG. 1 with an optional shroud.

The mounting component 18 can be connected to a different mounting devices, for example the post mounting device shown in FIGS. 1-3 or the wall or surface mounting device 42 shown in FIG. 16. Other mounting devices and types of mounting components can be used as would be understood by one of ordinary skill in the art to position the luminaire 10 on the ground, wall, pole, or other surface. FIG. 17 shows the luminaire utilizing a directional shroud 44. Other types of shrouds can also be used as would be understood by one of ordinary skill in the art.

Based on the above, various exemplary embodiments are directed to methods of selecting and combining different components, such as different outer and inner reflectors 24, 26, different mounting components 18, and different shrouds, to create a desired light output.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a front housing having a first interior portion at least partially defined by a first outer wall and a first back wall;

a rear housing having a second interior portion at least partially defined by a second outer wall, a second back wall, and a front opening the first back wall separates the first interior portion from the second interior portion;

a gasket positioned between the front housing and the rear housing to seal the front opening;

an outer reflector positioned in the interior portion of the front housing and extending at least partially between the back wall and the front opening, wherein the outer reflector includes a mounting feature; and an inner reflector positioned inside of the outer reflector, wherein the inner reflector has a base connected to the mounting feature, wherein the rear housing is connected to the front housing and the first back wall separates the first interior portion from the second interior portion.

2. The luminaire of claim 1, wherein the front housing includes a first heat fin and the rear housing includes a second heat fin.

3. The luminaire of claim 2, wherein the first and second heat fins extend from an outer surface of the respective outer walls.

4. The luminaire of claim 3, wherein the first and second heat fins are aligned.

5. The luminaire of claim 1, wherein a LED module is positioned in the front housing and a control component is positioned in the rear housing.

6. The luminaire of claim 1, wherein the gasket includes an outer edge approximately aligned with a front housing outer edge and a rear housing outer edge.

7. The luminaire of claim 1, wherein the gasket includes a first flange contacting the front housing and a second flange contacting to the rear housing.

8. A luminaire comprising:

a front housing having a first interior portion at least partially defined by a first outer wall, a first front opening, and a first back wall opposite the first front opening;

a rear housing having a second interior portion at least partially defined by a second outer wall, a second front opening, and a second back wall opposite the second front opening;

a control component positioned in the rear housing and separated from the front housing by the first back wall;

a light emitter positioned in the front housing to emit light through the first front opening and operably connected to the control component;

an outer reflector positioned in the interior portion of the front housing and extending at least partially between the back wall and the front opening, wherein the outer reflector includes a mounting feature; and an inner reflector positioned inside of the outer reflector, wherein the inner reflector has a base connected to the mounting feature.

9. The luminaire of claim 8, wherein the first back wall includes a conductor opening and a conductor passes through the conductor opening to connect the light emitter to the control component.

10. The luminaire of claim 8, wherein the rear housing includes a plurality of heat fins extending from an inside surface into the rear housing.

11. The luminaire of claim 8, wherein the front housing includes a first set of heat fins extending from an outer surface and the rear housing includes a second set of heat fins extending from an outer surface and aligned with the first set of heat fins.

12. The luminaire of claim 8, wherein the front housing includes a first set of fastener bosses and the rear housing includes a second set of fastener bosses aligned with the first set of fastener bosses.

13. The luminaire of claim 8, wherein a gasket is positioned between the front housing and the rear housing.

14. A luminaire comprising:

a front housing having an interior portion at least partially defined by an outer wall, a front opening, and a back wall opposite the first front opening;

an outer reflector positioned in the interior portion of the front housing and extending at least partially between the back wall and the front opening;

an inner reflector connected to the outer reflector and positioned inside of the outer reflector; and a rear housing connected to the front housing, wherein the outer reflector includes a mounting feature and the inner reflector includes a base connected to the mounting feature.

15. The luminaire of claim 14, wherein the mounting feature includes a protrusion having a flange.

16. The luminaire of claim 15, wherein the base is crimped to the flange.

17. The luminaire of claim 14, wherein the mounting feature extends from the back wall of the front housing that at least partially separates the front housing from the back housing.

* * * * *